US011676780B1

(12) United States Patent
Ku

(10) Patent No.: US 11,676,780 B1
(45) Date of Patent: Jun. 13, 2023

(54) LONG KEYBOARD KEY DEVICE

(71) Applicant: SUNREX TECHNOLOGY CORP., Taichung (TW)

(72) Inventor: Chih-Po Ku, Taichung (TW)

(73) Assignee: SUNREX TECHNOLOGY CORP., Taichung (TW)

( * ) Notice: Subject to any disclaimer, the term of this patent is extended or adjusted under 35 U.S.C. 154(b) by 0 days.

(21) Appl. No.: 17/890,119

(22) Filed: Aug. 17, 2022

(30) Foreign Application Priority Data

Feb. 9, 2022 (TW) ..... 111104693

(51) Int. Cl.
*H01H 13/705* (2006.01)
*H01H 13/86* (2006.01)

(52) U.S. Cl.
CPC ..... *H01H 13/86* (2013.01); *H01H 13/705* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS 11,152,168 B1 * 10/2021 Wu ..... H01H 3/122
11,342,139 B1 * 5/2022 Zhu ..... H01H 13/705
2018/0197698 A1 * 7/2018 Chung ..... H01H 13/84

* cited by examiner

*Primary Examiner* — Ahmed M Saeed
(74) *Attorney, Agent, or Firm* — DLA Piper LLP US

(57) ABSTRACT

A long keyboard key device includes a base plate, a keycap, and a support unit disposed between the base plate and the keycap and including outer and inner frame members that are pivotally connected together. The outer frame member has a frame body, two first engaging parts engaging rotatably first pivotal mounting brackets of the base plate, and a first balance rod embedded in the frame body and having a plurality of engaging sections that engage rotatably first clips of the keycap. The inner frame member has a frame plate, a plurality of second engaging parts engaging rotatably second pivotal mounting brackets of the base plate, and a plurality of third engaging parts engaging rotatably second clips of the keycap.

6 Claims, 7 Drawing Sheets

LONG KEYBOARD KEY DEVICE

CROSS-REFERENCE TO RELATED APPLICATION

This application claims priority to Taiwanese Patent Application No. 111104693, filed on Feb. 9, 2022.

FIELD

The disclosure relates to a keyboard, more particularly to a long keyboard key device.

BACKGROUND

In a keyboard, long keys such as the space bar, the enter key, the backspace key, and so on, are frequently designed to have relatively long keycaps to improve input efficiency.

A conventional long key of a typical keyboard includes a keycap and two balance rods for preventing the keycap from being inclined to one side due to unequal force exerted thereon when a user presses the conventional long key. Each balance rod has two ends engaging respectively two holding mechanisms on a base plate of the typical keyboard, allowing the keycap to drop smoothly when the user hits the conventional long key.

However, because the balance rods and the base plate are both constructed of metal, when the conventional long key is pressed, the balance rods will collide with the base plate, causing vibrations and noise. When the conventional long key is not pressed, the balance rods are movable within an area defined by a holding mechanism of the base plate. If a built-in speaker of a computer to which the typical keyboard is connected plays music, the balance rods are prone to resonate with the music, then hit the holding mechanism and the base plate, causing noise.

SUMMARY

Therefore, the object of the disclosure is to provide a long keyboard key device which can alleviate at least one of the shortcomings of the prior art.

According to the disclosure, a long keyboard key device includes a base plate, a keycap, and a support unit.

The base plate includes a plate body, two first pivotal mounting brackets, and two second pivotal mounting brackets. The first pivotal mounting brackets are spaced apart along a first axis extending in a left-right direction and are mounted on a top surface of the plate body. The second pivotal mounting brackets are spaced apart along a second axis extending in the left-right direction and are mounted on the top surface of the plate body. The first and second axes are spaced apart in a front-rear direction that is perpendicular to the left-right direction. The keycap has an inner bottom surface that faces the base plate, a plurality of first clips, and a plurality of second clips. The first clips are spaced apart along a third axis extending in the left-right direction and that are mounted on the inner bottom surface. The second clips are spaced apart along a fourth axis extending in the left-right direction and that are mounted on the inner bottom surface. The third and fourth axes are spaced apart in the front-rear direction.

The support unit is disposed between the base plate and the inner bottom surface of the keycap, and includes an outer frame member and an inner frame member. The outer frame member has a frame body, two first engaging parts, and a first balance rod. The first engaging parts are spaced apart from each other in the left-right direction, are mounted on the frame body, and engage rotatably and respectively the first pivotal mounting brackets. The first balance rod is embedded in the frame body, and has a plurality of engaging sections that are spaced apart in the left-right direction, that are exposed from the frame body, and that engage rotatably and respectively the first clips. The inner frame member has a frame plate, a plurality of second engaging parts, and a plurality of third engaging parts. The frame plate is connected pivotally to an inner circumference of the frame body. The second engaging parts are spaced apart from each other in the left-right direction, are mounted on the frame plate, and engage rotatably and respectively the second pivotal mounting brackets. The third engaging parts are spaced apart from each other in the left-right direction, are mounted on the frame plate, and engage rotatably and respectively the second clips.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
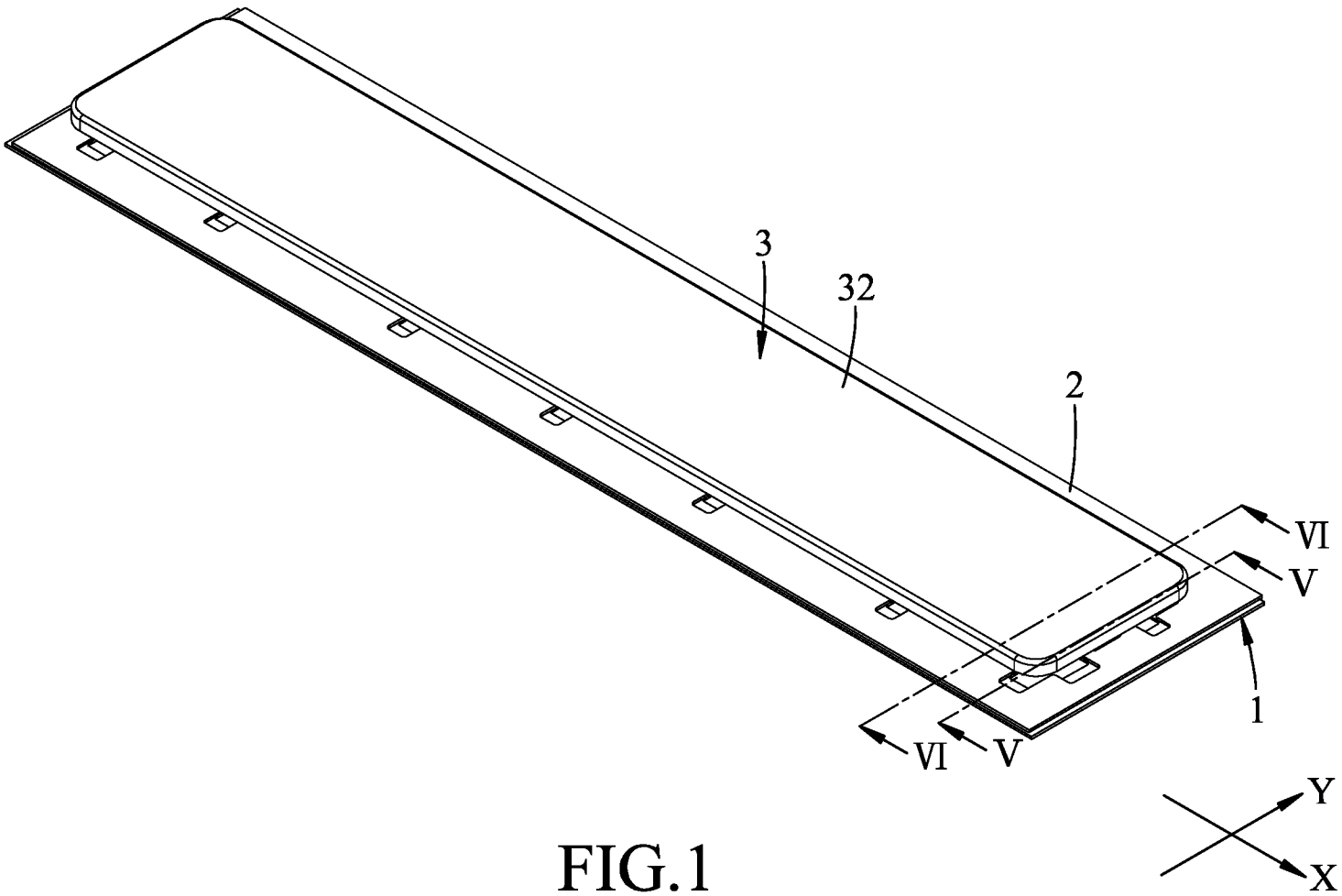
FIG. 1 is a perspective view of an embodiment of a long keyboard key device according to the disclosure.
Figure 2:
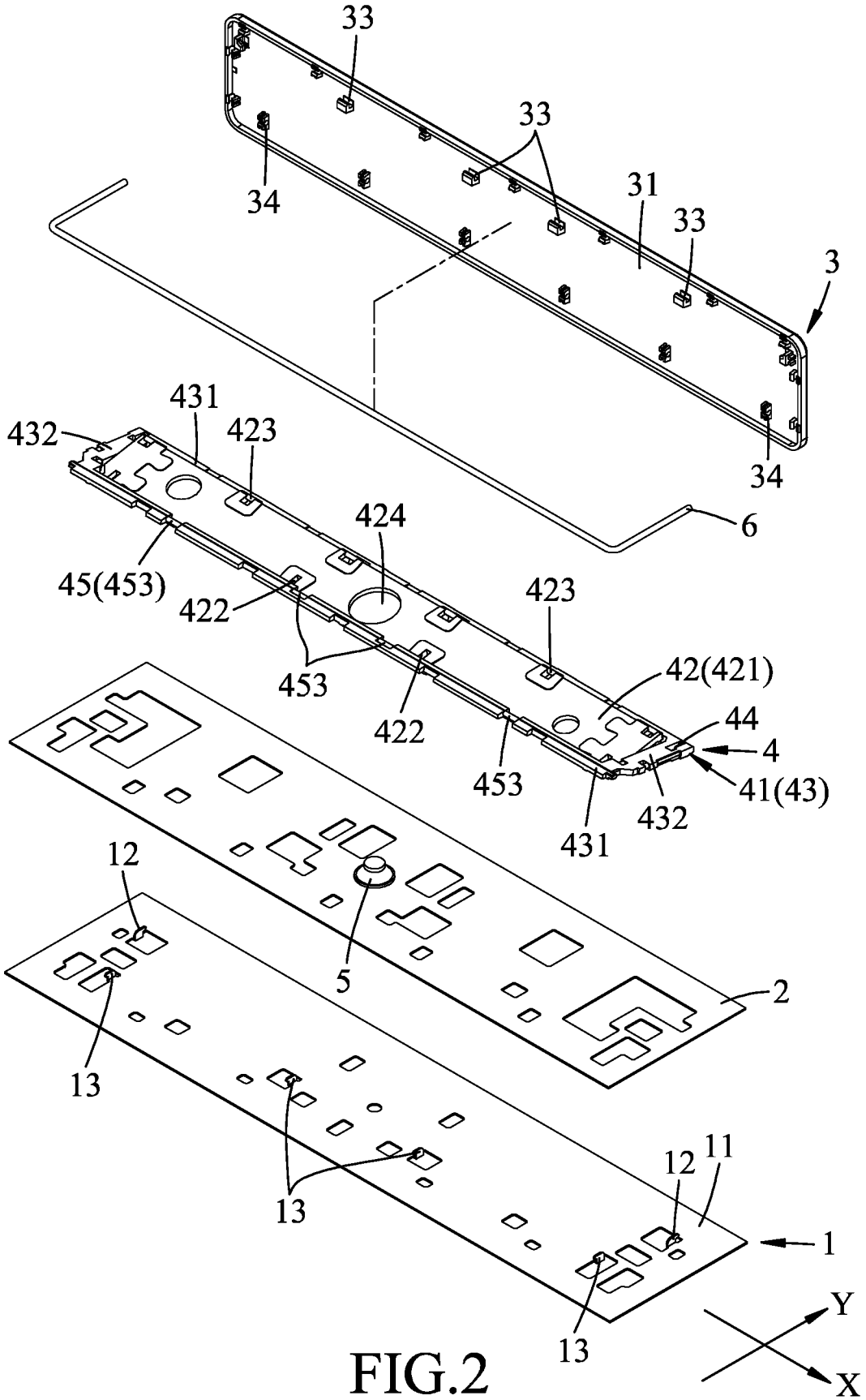
FIG. 2 is an exploded perspective view of this embodiment.

Referring to FIGS. 1 and 2, an embodiment of the long keyboard key device of the present disclosure includes a base plate 1, a thin film circuit board 2, a keycap 3, a support unit 4, an elastomer component 5, and a reinforcing component 6.

The base plate 1 includes a plate body 11 that is elongated in a left-right direction (X), two first pivotal mounting brackets 12 that are spaced along a first axis extending in the left-right direction (X) and that are mounted on a top surface of the plate body 11, and four second pivotal mounting brackets 13 that are spaced apart along a second axis extending in the left-right direction (X) and that are mounted on the top surface of the plate body 11. The first and second axes are spaced apart in a front-rear direction (Y) perpendicular to the left-right direction (X). The second pivotal mounting brackets 13 are located on the front side of the first pivotal mounting brackets 12. It is worth noting that the number of the first pivotal mounting brackets 12 and the second pivotal mounting brackets 13 can be customized to meet specific needs and are not limited to the number in this embodiment.

The thin film circuit board 2 is disposed over the base plate 1. Since the function of the thin film circuit board 2 (i.e., a signal will be generated when a pressure is exerted on the thin film circuit board 2) is common knowledge in the field of thin film circuit board keyboards and has no bearing on the technical feature of the disclosure, it will not be discussed further hereinafter.

The keycap 3 is elongated in the left-right direction (X), and has an inner bottom surface 31 that faces the base plate 1, an outer top surface 32 that is opposite to the inner bottom surface 31, four first clips 33 that are spaced apart along a third axis extending in the left-right direction (X) and that are mounted on the inner bottom surface 31, and six second clips 34 that are spaced apart along a fourth axis extending in the left-right direction (X) and that are mounted on the inner bottom surface 31. The third and fourth axes are spaced apart in the front-rear direction (Y), with the first clips 33 being in front of the second clips 34. It is worth noting that the number of the first clips 33 and the second clips 34 can be customized to meet specific needs and is not limited to this embodiment.

Figure 3:
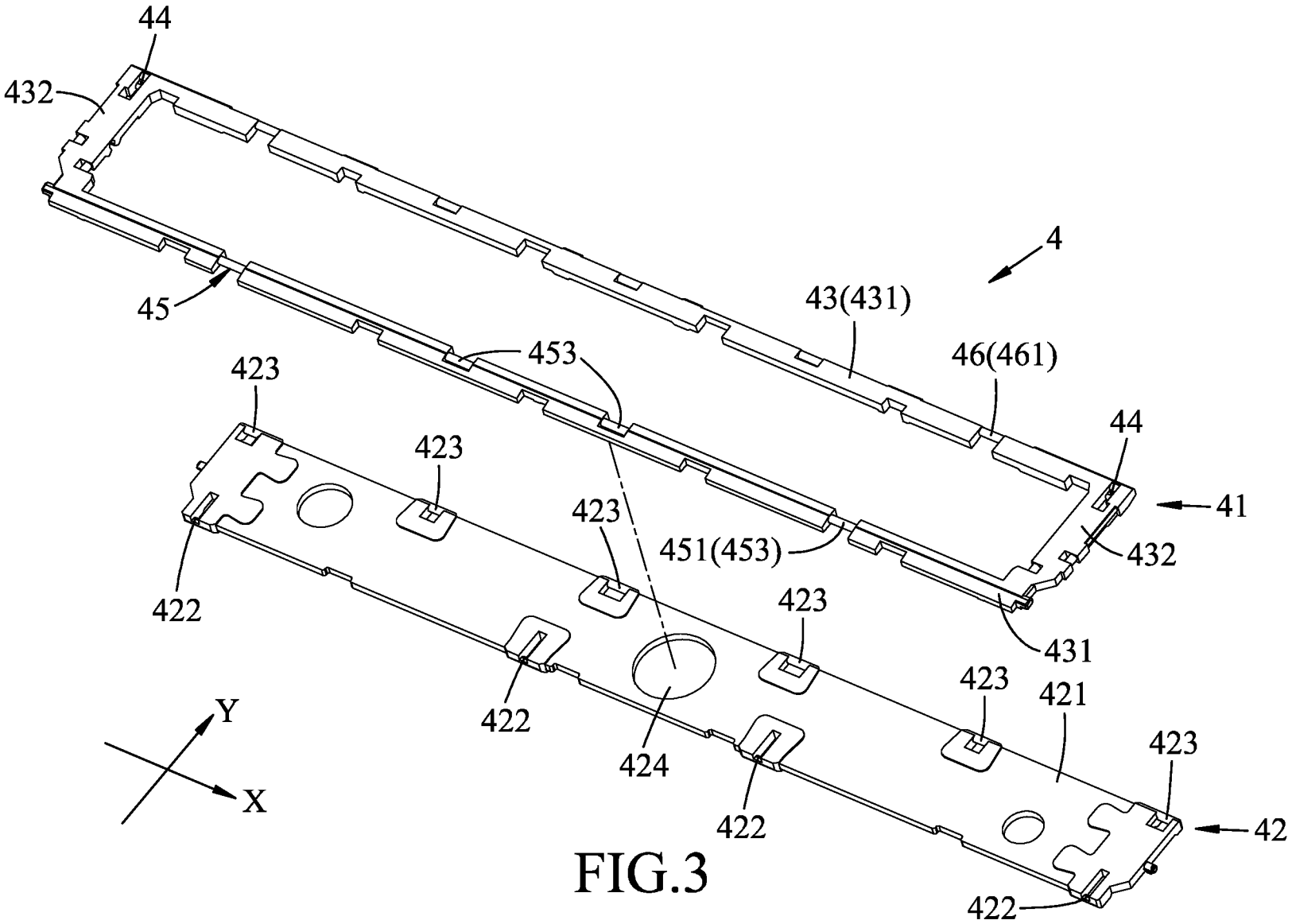
FIG. 3 is an exploded perspective view of a support unit of this embodiment.
Figure 4:
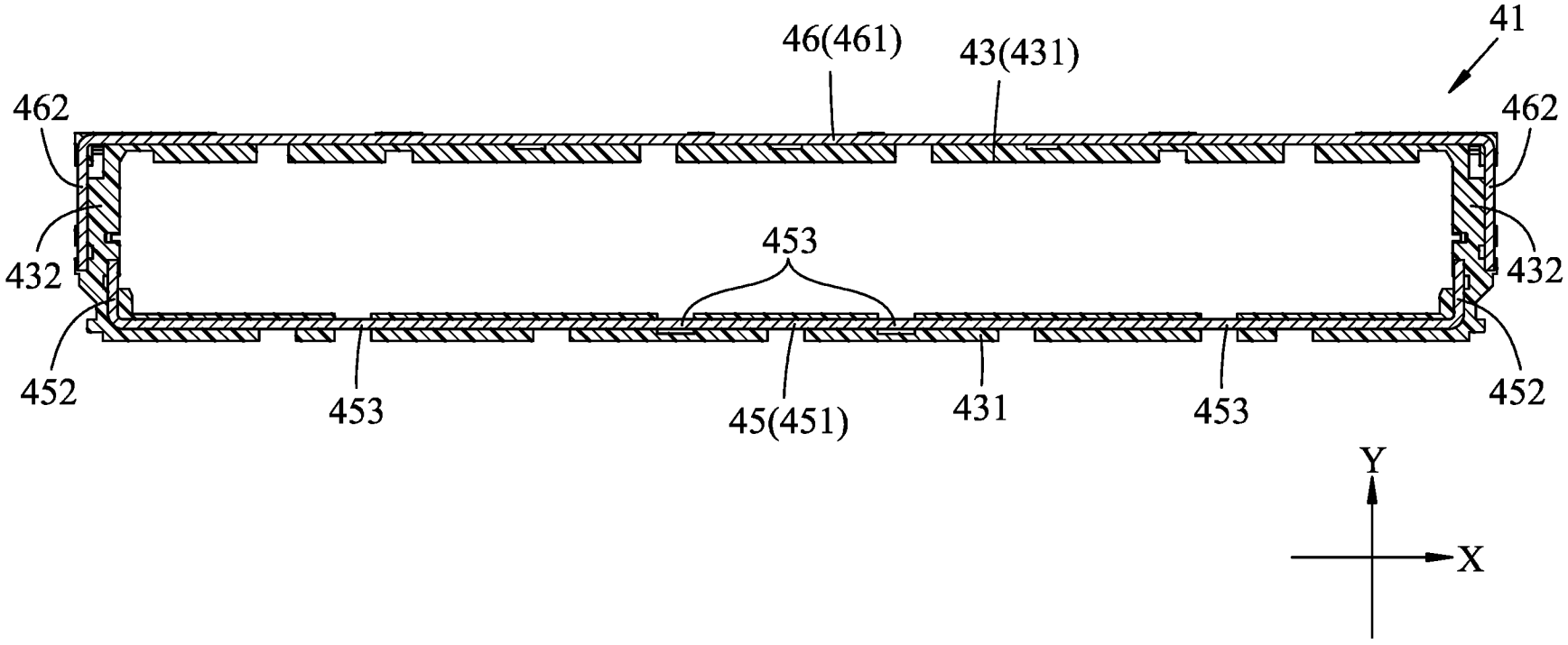
FIG. 4 is a horizontal cross-sectional view of an outer frame member of the support unit of this embodiment.

Referring to FIGS. 2 to 4, the support unit 4 is disposed between the base plate 1 and the inner bottom surface 31 of the keycap 3, and includes an outer frame member 41 and an inner frame member 42 pivotally connected to an inner circumference of the outer frame member 41.

The outer frame member 41 has a frame body 43, two first engaging parts 44, a first balance rod 45 and a second balance rod 46. The first engaging parts 44 are spaced apart from each other in the left-right direction (X) and engaging respectively and rotatably the first pivotal mounting brackets 12. The first balance rod 45 and the second balance rod 46 are both embedded in the frame body 43. The frame body 43 has two long frame segments 431 extending in the left-right direction (X) and spaced apart in the front-rear direction (Y), and two short frame segments 432 extending in the front-rear direction (Y), spaced apart in the left-right direction (X), and connected between the two long frame segments 431. The first engaging parts 44 are disposed on a rear one of the long frame segments 431. The first balance rod 45 has a first long rod portion 451 and two first short rod portions 452. The first long rod portion 451 extends in the left-right direction (X) and is embedded in a front one of the long frame segments 431. The two first short rod portions 452 extend rearwardly and respectively from opposite ends of the first long rod portion 451, and are embedded respectively in the short frame segments 432. The first long rod portion 451 has four engaging sections 453 spaced apart in the left-right direction (X), exposed from the front one of the long frame segments 431, and engaging rotatably and respectively the first clips 33. The second balance rod 46 has a second long rod portion 461 that extends in the left-right direction (X) and that is embedded in the rear one of the long frame segments 431, and two second short rod portions 462 that extend forwardly and respectively from opposite ends of the second long rod portion 461, and that are embedded respectively in the short frame segments 432. Since the first balance rod 45 and the second balance rod 46 are both embedded in the frame body 43, when the keycap 3 is pressed, the first balance rod 45 and the second balance rod 46 would not come into contact with the base plate 1, so that noise generated when the keycap 3 is pressed would be reduced. In addition, the configuration of the first balance rod 45 and the second balance rod 46 can enhance the structural strength of the frame body 43. It is worth noting that the number of the first engaging parts 44 may vary in coordination with the number of the first pivotal mounting brackets 12. Likewise, the number of the engaging sections 453 may vary in coordination with the number of the first clips 33 and is not limited to the number in this embodiment.

The inner frame member 42 has a frame plate 421, four second engaging parts 422, six third engaging parts 423, and a through hole 424 at the center of the frame plate 421. The frame plate 421 is connected pivotally to an inner circumference of the frame body 43. The second engaging parts 422 are spaced apart in the left-right direction (X), are mounted on the frame plate 421, and engage rotatably and respectively the second pivotal mounting brackets 13. The third engaging parts 423 are spaced apart in the left-right direction (X), are mounted on the frame plate 421, and engage rotatably and respectively the second clips 34. The second engaging parts 422 are located in front of the third engaging parts 423. The number of the second engaging parts 422 may vary in coordination with the number of the second pivotal mounting brackets 13. Likewise, the number of the third engaging parts 423 may vary in coordination with the number of the second clips 34 and is not limited to the number in this embodiment. In this embodiment, the frame plate 421 is made of a metal sheet, and the second engaging parts 422 and the third engaging parts 423 are made of plastics and are inserted in the frame plate 421. The leftmost second engaging part 422 and the leftmost third rotatable engaging part 423 are made in one piece which is engages the left end of the frame plate 421, and which is pivotally connected to a left one of the short frame segments 432 of the frame body 43. The rightmost second engaging part 422 and the rightmost third engaging part 423 are also made in one piece which engages the right end of the frame plate 421, and which is pivotally connected to a right one of the short frame segments 432 of the frame body 43. It is noted that, in other embodiments, the frame plate 421 may be pivotally and directly connected to the short frame segments 432 of the frame body 43, with each of the second and third engaging parts 422, 423 being separately engaged with the frame plate 421 and not located at opposite ends of the frame plate 421.

The elastomer component 5 is disposed on the thin film circuit board 2, extends through the through hole 424 of the inner frame member 42, and abuts against the keycap 3. In this embodiment, the elastomer component 5 is a rubber dome.

The reinforcing member 6 is mounted on the inner bottom surface 31 of the keycap 3, and has a main portion extending in the left-right direction (X), and two side portions connected perpendicularly and respectively to opposite ends of the main portion. The reinforcing member 6 is made of metal to strengthen the structural strength of the keycap 3.

Figure 5:
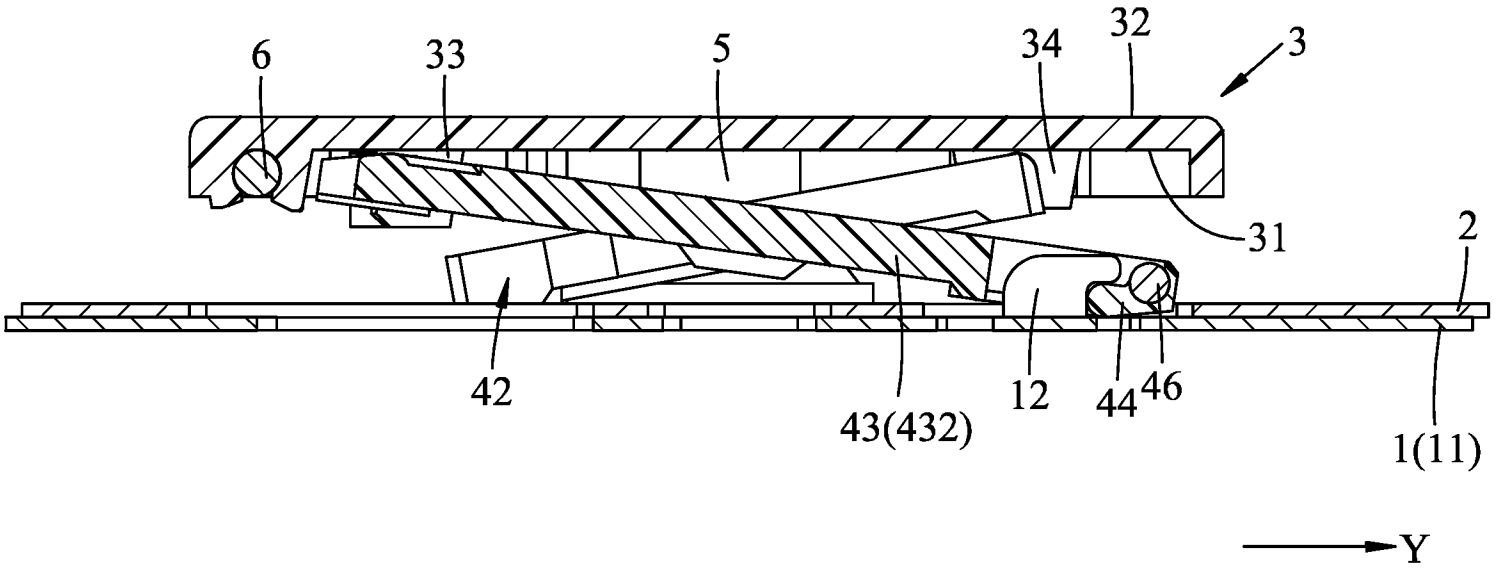
FIG. 5 is a vertical cross-sectional view taken along line V-V in FIG. 1, illustrating the embodiment in a non-pressed state.
Figure 6:
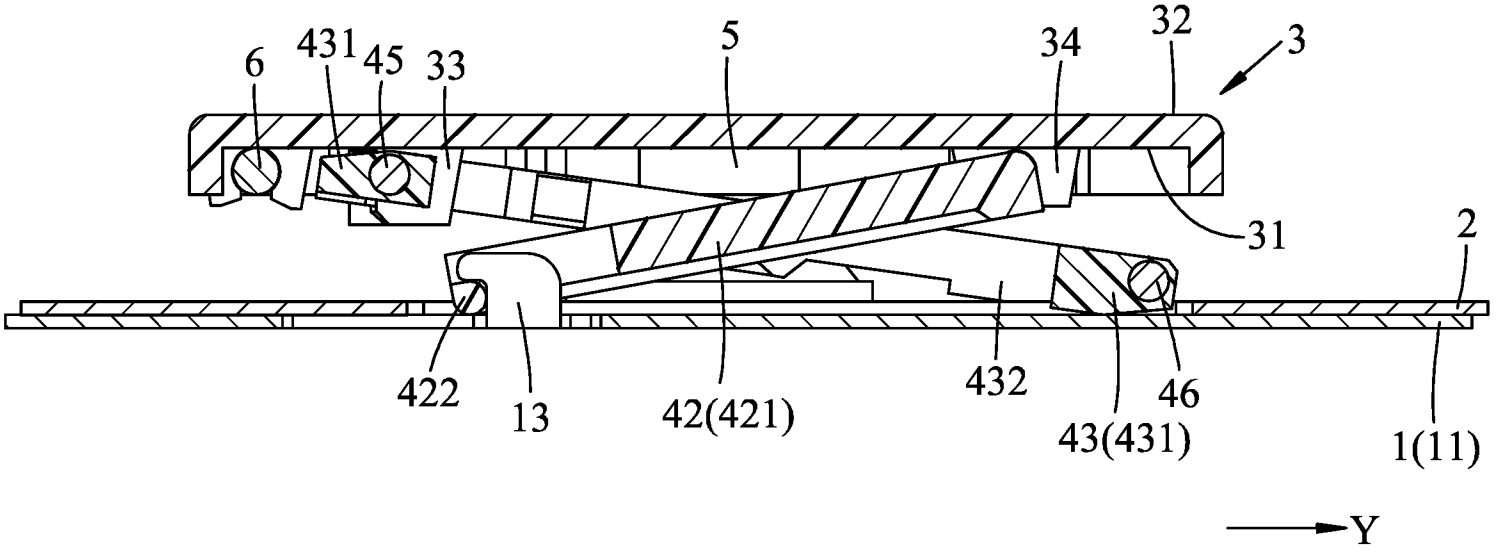
FIG. 6 is a vertical cross-sectional view taken along line VI-VI of FIG. 1, illustrating the embodiment in the non-pressed state.
Figure 7:
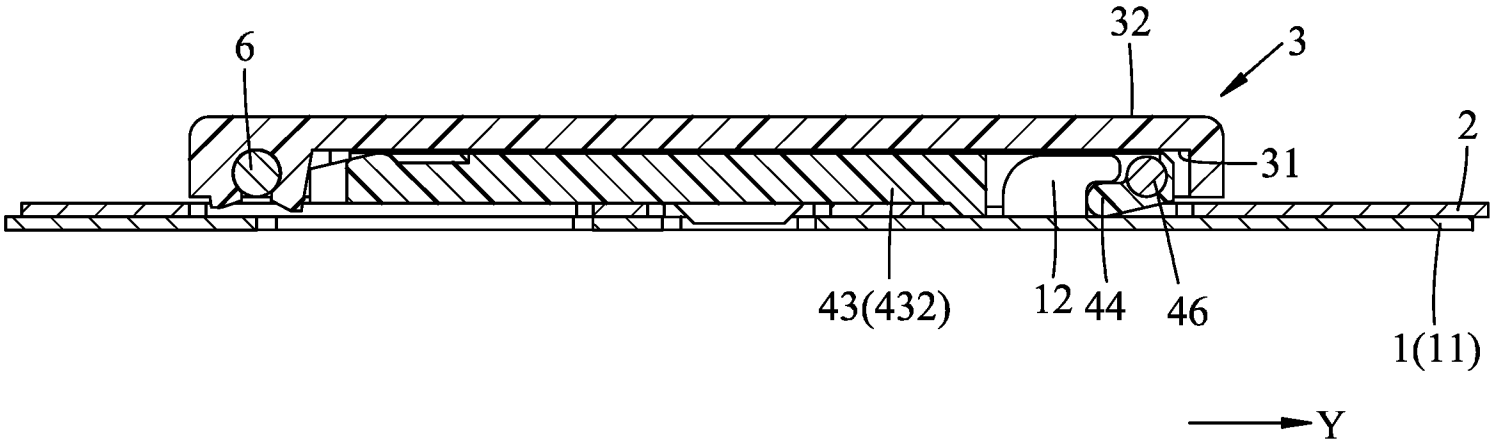
FIG. 7 is a vertical cross-sectional view similar to FIG. 5, but illustrating the embodiment in a pressed state.

Referring to FIGS. 5 to 7, when the keycap 3 is not pressed by the user, the embodiment is in the non-pressed state (as shown in FIGS. 5 and 6). At this time, the keycap 3 remains away from the base plate 1 under the resilient force exerted by the elastomer component 5. Meanwhile, the front one of the long frame segments 431 of the frame body 43 connected to the keycap 3 is biased away from the base plate 1, and a rear end of the frame plate 421 connected to the keycap 3 is also biased away from the base plate 1. Since the outer frame member 41 and the inner frame member 42 are pivotally connected, the performance of the elastomer component 5 will urge the first engaging parts 44 of the outer frame member 41 to engage tightly the first pivotal mounting brackets 12, and will also urge the second engaging parts 422 of the inner frame member 42 to engage tightly the second pivotal mounting brackets 13. At this time, if the computer equipped with this embodiment plays music, resonance that causes noise is eliminated.

When the keycap 3 is pressed and the keycap 3 moves toward the base plate 1, the two first engaging parts 44 of the outer frame member 41 respectively rotate relative to the first pivotal mounting brackets 12, the engaging sections 453 respectively rotate relative to the first clips 33, the second engaging parts 422 of the inner frame member 42 respectively rotate relative to the second pivotal mounting brackets 13, and the third engaging parts 423 respectively rotate relative to the second clips 34 until the embodiment is converted to the pressed state as shown in FIG. 7.

To summarize, by virtue of the support unit 4 being pivotally disposed between the base plate 1 and the keycap 3 and having the outer frame member 41 and the inner frame member 42 that are pivoted to each other, the keycaps 3 can be smoothly pressed from the non-pressed state to the pressed state. Moreover, by embedding the first balance rod 45 in the frame body 43 to avoid contact with the base plate 1, the sound produced by the long keyboard key device when the keycap 3 is pressed can be decreased, and the structural strength of the frame body 43 can be enhanced. Furthermore, the second balance rod 46 embedded in the frame body 43 can also enhance the structural strength of the frame body 43 and reduce the sound produced when the keycap 3 is pressed. Therefore, the object of the present disclosure can indeed be achieved.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A long keyboard key device comprising:

a base plate including a plate body, two first pivotal mounting brackets that are spaced apart along a first axis extending in a left-right direction and that are mounted on a top surface of said plate body, and a plurality of second pivotal mounting brackets that are spaced apart along a second axis extending in said left-right direction and that are mounted on said top surface of said plate body, the first and second axes being spaced apart in a front-rear direction that is perpendicular to said left-right direction;

a keycap having an inner bottom surface that faces said base plate, a plurality of first clips that are spaced apart along a third axis extending in said left-right direction and that are mounted on said inner bottom surface, and a plurality of second clips that are spaced apart along a fourth axis extending in said left-right direction and that are mounted on said inner bottom surface, the third and fourth axes being spaced apart in said front-rear direction; and a support unit disposed between said base plate and said inner bottom surface of said keycap, and including an outer frame member that has a frame body, two first engaging parts spaced apart from each other in said left-right direction, mounted on said frame body, and engaging rotatably and respectively said first pivotal mounting brackets, and a first balance rod embedded in said frame body, and having a plurality of engaging sections that are spaced apart in said left-right direction, that are exposed from said frame body, and that engage rotatably and respectively said first clips, and an inner frame member that has a frame plate connected pivotally to an inner circumference of said frame body, a plurality of second engaging parts spaced apart from each other in said left-right direction, mounted on said frame plate, and engaging rotatably and respectively said second pivotal mounting brackets, and a plurality of third engaging parts spaced apart from each other in said left-right direction, mounted on said frame plate, and engaging rotatably and respectively said second clips.

2. The long keyboard key device as claimed in claim 1, wherein:

said inner frame member further has a through hole formed in said frame plate;

said long keyboard key device further comprises a thin film circuit board disposed over said base plate, and an elastomer component disposed on said thin film circuit board, extending through said through hole of said inner frame member, and abuts against said keycap.

3. The long keyboard key device as claimed in claim 1, wherein:

said frame body has two long frame segments extending in said left-right direction and spaced apart in said front-rear direction, and two short frame segments extending in said front-rear direction and connected between said two long frame segments; and said first balance rod has a first long rod portion extending in said left-right direction, embedded in a front one of said long frame segments, and having said engaging sections, and two first short rod portions extending rearwardly and respectively from opposite ends of said first long rod portion, and embedded respectively in said two short frame segments.

4. The long keyboard key device as claimed in claim 3, wherein said outer frame member further has a second balance rod having:

a second long rod portion that extends in said left-right direction and that is embedded in a rear one of said long frame segments; and two second short rod portions that extend forwardly and respectively from opposite ends of said second long rod portion, and that are embedded respectively in said short frame segments.

5. The long keyboard key device as claimed in claim 1, further comprising a reinforcing component that has a main portion extending in said left-right direction and mounted on said inner bottom surface of said keycap, and that is made of metal.

6. The long keyboard key device as claimed in claim 1, wherein:

said frame plate is made of a metal sheet; and said second engaging parts and said third engaging parts are made of plastics and are inserted in said frame plate.

* * * * *